US008424277B2

(12) United States Patent
Koller et al.

(10) Patent No.: US 8,424,277 B2
(45) Date of Patent: Apr. 23, 2013

(54) SADDLE GIRTH

(75) Inventors: Shari Koller, New Egypt, NJ (US); Roger Koller, New Egypt, NJ (US); Hans Spirig, St. Gallen (CH); Michael Spirig, St. Gallen (CH)

(73) Assignee: Spirig Saddlery, USA, LLC

( * ) Notice: Subject to any disclaimer, the term of this patent is extended or adjusted under 35 U.S.C. 154(b) by 1258 days.

(21) Appl. No.: 11/801,314

(22) Filed: May 9, 2007

(65) Prior Publication Data

US 2010/0293903 A1 Nov. 25, 2010

(51) Int. Cl.
*B68C 1/14* (2006.01)

(52) U.S. Cl.
USPC ..... 54/23

(58) Field of Classification Search ..... 54/23, 44.1, 54/44.3
See application file for complete search history.

(56) References Cited

U.S. PATENT DOCUMENTS

| | | | | |
|---|---|---|---|---|
| 266,571 | A | 10/1882 | Williams | |
| 302,019 | A | 7/1884 | Parshall | |
| 370,208 | A | 9/1887 | Pefley | |
| 532,906 | A | 1/1895 | Rahn, C. A. | |
| 1,678,373 | A | 7/1928 | Wiesenfeld | |
| 1,759,172 | A | 5/1930 | Smalley | |
| 2,066,855 | A | 1/1937 | Robertson | |
| 2,130,214 | A | 9/1938 | Wright | |
| 2,239,764 | A | 4/1941 | Vordemberge | |
| 2,252,257 | A | 8/1941 | Harvey | |
| 2,567,019 | A | 9/1951 | Johnson | |
| 3,457,702 | A | 7/1969 | Brown | |
| 3,805,491 | A | 4/1974 | Deal | |
| 3,828,521 | A | 8/1974 | Dulaney | |
| 3,913,302 | A | 10/1975 | Centers | |
| 3,918,407 | A | 11/1975 | Greenberg | |
| 4,018,035 | A | 4/1977 | Morrison | |
| 4,132,055 | A | 1/1979 | Bird | |
| 4,147,015 | A | 4/1979 | Land | |
| 4,187,663 | A | 2/1980 | LaCroix, Jr. | |
| 4,277,933 | A | 7/1981 | Verdier | |
| 4,434,604 | A | 3/1984 | Bird | |
| 4,506,496 | A | 3/1985 | Olson | |
| 4,570,424 | A | 2/1986 | Simpson | |
| 4,709,539 | A | 12/1987 | Bird | |
| 4,800,709 | A | 1/1989 | Le Tixerant | |
| 4,905,458 | A | 3/1990 | Johnston et al. | |
| 4,999,980 | A | 3/1991 | McGowan | |
| 5,566,533 | A | 10/1996 | Larisch | |
| 5,768,864 | A | 6/1998 | Chang | |
| 5,799,473 | A | 9/1998 | Goblet | |
| 5,901,531 | A | 5/1999 | Rogers | |
| 5,946,892 | A * | 9/1999 | Siddoway | 54/23 |
| 6,502,376 | B1 | 1/2003 | Swain | |
| 7,121,068 | B2 | 10/2006 | Van Scoyk | |

* cited by examiner

*Primary Examiner* — Son T Nguyen
(74) *Attorney, Agent, or Firm* — Graham Curtin, P.A.; Glen M. Diehl

(57) ABSTRACT

The present invention is a saddle girth to be used in conjunction with either English or Western saddles. The girth band of the saddle girth is curved and made with an inelastic member which provides a more secure and comfortable fit on the horse. The saddle girth connectors are made of elastic material which allows for expansion of the horse's chest as it breaths. This saddle girth prevents shifting of the girth or saddle while fitting comfortably around the torso of the horse providing comfort and security to both the hose and rider.

8 Claims, 4 Drawing Sheets

SADDLE GIRTH

FIELD OF THE INVENTION

This invention relates to saddle girths for horses, and more particularly to a novel saddle girth that inhibits the saddle from shifting preventing chafing and sores, providing more comfort for the horse and a more stable seat for the rider.

BACKGROUND OF THE INVENTION

Equestrian saddles are held in place on a horse's back by a girth which attaches to either side of the saddle and extends under the horse's belly. Girths for English or Dressage saddles typically have two or three buckles on each end; girths for Western saddles have a single buckle on each end and a pair of girth rings at the center of the girth on its outside layer.

A well known problem with traditional saddle girths is that they typically allow considerable movement of the saddle during riding. Saddles are also known to shift along the longitudinal axis of the horse. This movement causes chafing and sores to develop as the saddle girth and/or saddle move over the horse's withers, should blades and back. The movement also can be dangerous and disconcerting to the rider.

On method of reducing movement is to make the saddle girth extremely tight. This results in discomfort to the horse and will also increase chafing while restricting the horse's ability to expand its chest while breathing.

The present invention represents an improvement in previous saddle girths in that it offers greater flexibility, convenience, comfort and protection and the unique shape of the novel saddle girth overcomes disadvantages inherent in prior saddle girths.

SUMMARY OF THE INVENTION

The present invention is uniquely shaped saddle girth. An object of this invention is to provide a unique saddle girth that has been found to stabilize the saddle on the horse's back, even during rapid action events. The novel girth employs a unique shape and angled ends to provide a superior fit around the horse's torso. The novel girth also uses a combination of an inelastic layer interior to the girth strap with elastic connector straps to provide a snug fit while allowing greater comfort for the animal. Keepers retain the girth straps when attached to the saddle. These keepers can, for example, be in the form of sleeves as illustrated in one embodiment herein.

Another object of the invention is to securely hold the saddle on the back of the horse and prevent it from shifting during riding. The saddle girth will accomplish this by being able to be used with traditional western or dressage saddles in a manner familiar to equestrians.

Yet another object of the invention is for the saddle girth to retain its position around the torso of the horse so that it does not allow shifting or movement that will call chafing or sores.

Yet another objective of the invention is to provide increased stability for the rider resulting in greater comfort and confidence.

Previous saddle girths have employed straight sections in an attempt to overcome the shifting and movement of the saddle girth. These saddle girths typically slide forward towards the horse's forelegs causing the saddle to slide longitudinally along the back of the horse. This movement can result in irritation of the horse's ribcage and skin along the chest and torso. The instant invention overcomes these problems and disadvantages by curving the lines of the forward and rearward edges of the girth band to conform to the horse's torso and then angling the distal ends towards the rear of the horse thereby minimizing girth and saddle movement.

An example of a saddle girth is shown in U.S. Pat. No. 6,502,376, to Swain. Swain discloses a saddle girth with a central portion separating two opposing straight sections, each extending from the central portion at angles in a chevron shape. Swain employs a traditional saddle girth design which is split at the center. The straight sections still allow movement and do not follow the natural lines of the animal.

Another example of a saddle girth is shown in U.S. Pat. No. 5,566,533, to Larisch. Larisch discloses a saddle girth that is straight from end to end and is pulled across the horse's chest just beneath the point at which the girth is attached to the saddle. The Larisch design allows the girth to slide forward which causes it to loosen causing sores and chafing when the girth rubs against the chest and forelegs of the horse.

Yet another example of a saddle girth is shown in U.S. Pat. No. 4,905,458, to Johnston. Johnston discloses a saddle girth which completely encircles the torso of the horse which has gripping members extending from the inner surface of the girth to reduce movement. The Johnston design extends under the saddle causing pressure points and addition friction on the horses back.

Yet another example of a saddle girth is shown in U.S. Pat. No. 4,187,663, to LaCroix. LaCroix discloses a saddle girth which incorporates an elastic central belt to allow expansion as the animal breaths. However, the use of an elastic belt allows the girth to move causing shifting of the saddle and sores and chafing.

These and other objects, advantages and features of the invention will become apparent upon studying the following specification in conjunction with the drawings.

DETAILED DESCRIPTION OF THE INVENTION

Figure 1:
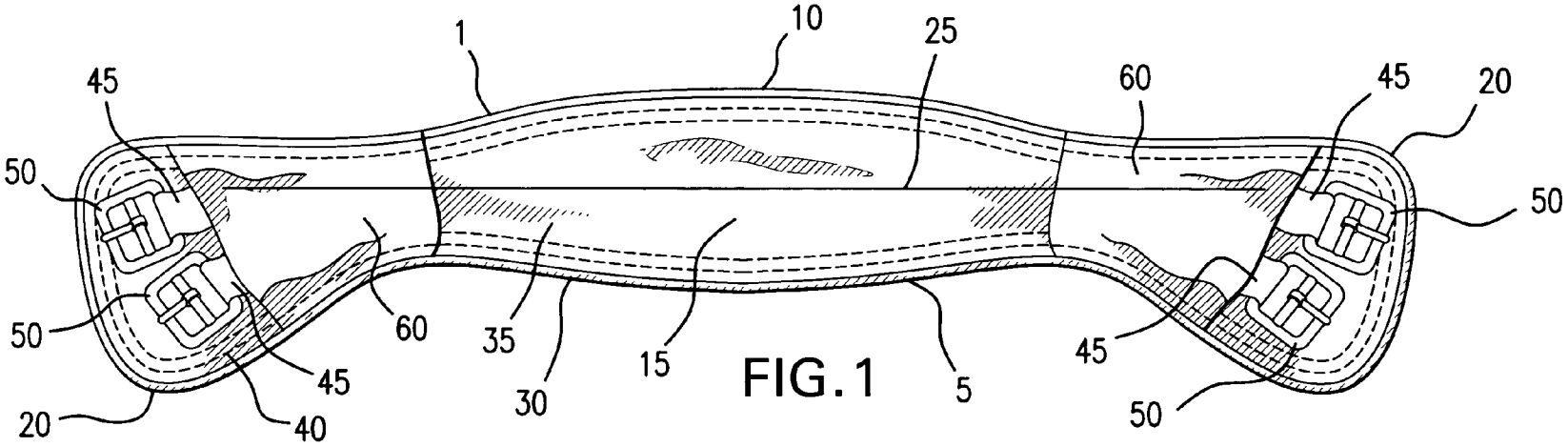
FIG. 1 is a perspective view of saddle girth.

Referring first to FIG. 1 which shows a perspective view of the saddle girth 1 for use in combination with a Dressage saddle which is constructed in accordance with the teachings of the present invention. The saddle girth 1 is between 610 mm and 915 mm in length. The length of the saddle girth 1 may vary to accommodate horses of various sizes. The saddle girth 1 is fitted around the horse's torso and attached to the saddle in the traditional manner and has a forward edge 5, a rearward edge 10, a midsection 15 and two distal ends 20. The forward edge 5 and rearward edge 10 of the saddle girth 1 is curved at the midsection 15 such that the saddle girth 1 is widest at its midpoint and narrowing at the ends of midsection 15 before flaring out at the distal ends 20. The distal ends 20 of the saddle girth are connected to the midsection 15 at an angle to the centerline 25 of said saddle girth 1 so as to provide a curved shape to the entire saddle girth 1. The inside surface 30 is joined to the outside surface 35 by stitching 40, although other methods for joining fabrics and materials known in the art may be used. At least one connector strap 45 attached to each said distal end 20 of said saddle girth 1, and a connector 50 attached to each said connector strap 45. The connector strap 45 being made of an elastic material which will allow the saddle girth 1 to conform and hold snug against the rib cage of a horse without chafing. The connectors 50 are typically buckles that are used to removably attach the saddle girth 1 to a saddle by means of the saddle straps 55 (illustrated FIG. 4), but the connectors 50 may be any element that accomplishes such a purpose. Keepers 60 of sufficient size to cover the point of attachment for the connector straps 45 to the saddle girth 1 and for the ends of the saddle straps 55 to be secured under them are fixedly attached to the saddle girth 1 at each distal end 20. The distal ends 20 are angled away from the centerline 25 of the saddle girth 1 at an angle of approximately 30 degrees. However, the angle may be varied to change the position of the saddle girth 1 on the horse.

Figure 2:
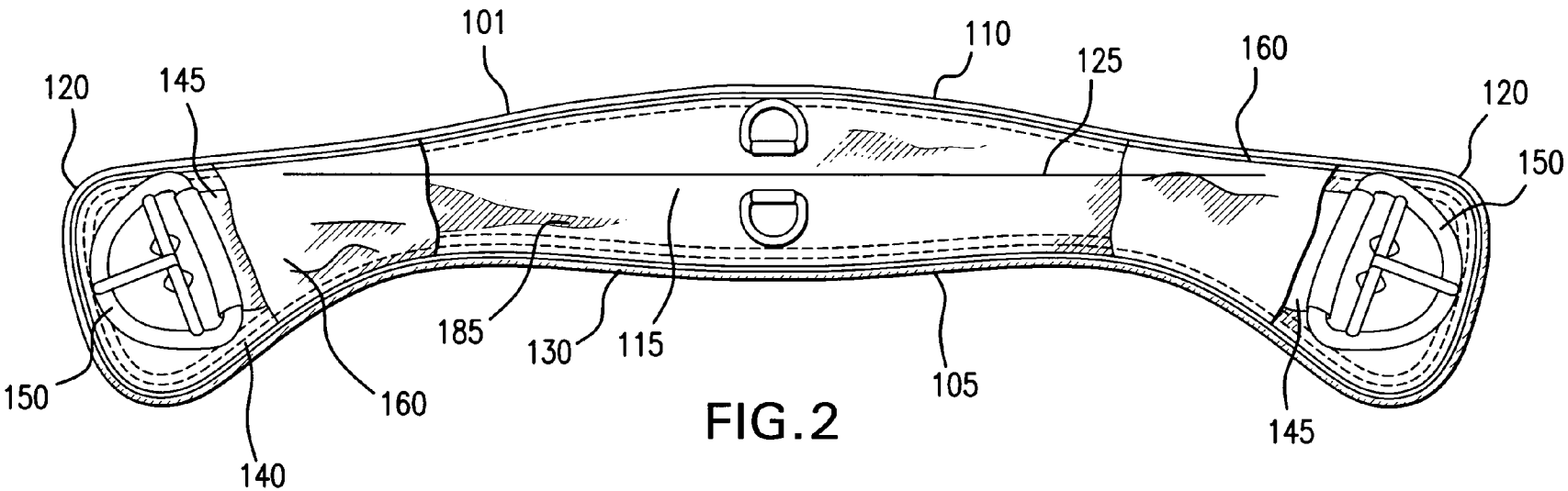
FIG. 2 is a perspective view of the saddle girth in its embodiment for use with western saddles.

FIG. 2 illustrates an alternative embodiment of the saddle girth for use with a Western saddle. The western saddle girth 101 is between 610 mm and 915 mm in length. The length of the western saddle girth 101 may vary to accommodate horses of various sizes. The western saddle girth 101 is fitted around the horse's torso and attached to the saddle in the traditional manner and has a forward edge 105, a rearward edge 110, a midsection 115 and two distal ends 120. The forward edge 105 and rearward edge 110 of the western saddle girth 101 is curved at the midsection 115 such that the western saddle girth 101 is widest at its midpoint and narrowing at the ends of midsection 115_before flaring out at the distal ends 120. The distal ends 120 of the western saddle girth 101 are connected to the midsection 115 at an angle to the centerline 125 of said western saddle girth 101 so as to provide a curved shape to the entire western saddle girth 101. The inside surface 130 is joined to the outside surface 135 by stitching 140, although other methods for joining fabrics and materials known in the art may be used. A connector strap 145 is attached to each distal end 120 of the western saddle girth 101, and a connector 150 is attached to ch said connector strap 145. The connector strap 145 being made of an elastic material which will allow the western saddle girth 101 to conform and hold snug against the rib cage of a horse without chafing. The connectors 150 are typically buckles that are used to removably attach the western saddle girth 101 to a saddle by means of the saddle strap 155 (illustrated FIG. 4), but the connectors 150 may be any element that accomplishes such a purpose. Keepers 160 of sufficient size to cover the point of attachment for the connector strap 145 to the western saddle girth 101 and for the ends of the saddle strap 155 to be secured under them are fixedly attached to the western saddle girth 101 at each distal end 120. The distal ends 120 are curved forward from the centerline 125 of the western saddle girth 101 at an angle of approximately 30 degrees. However, the angle may be varied to change the position of the western saddle girth 101 on the horse.

Figure 3:
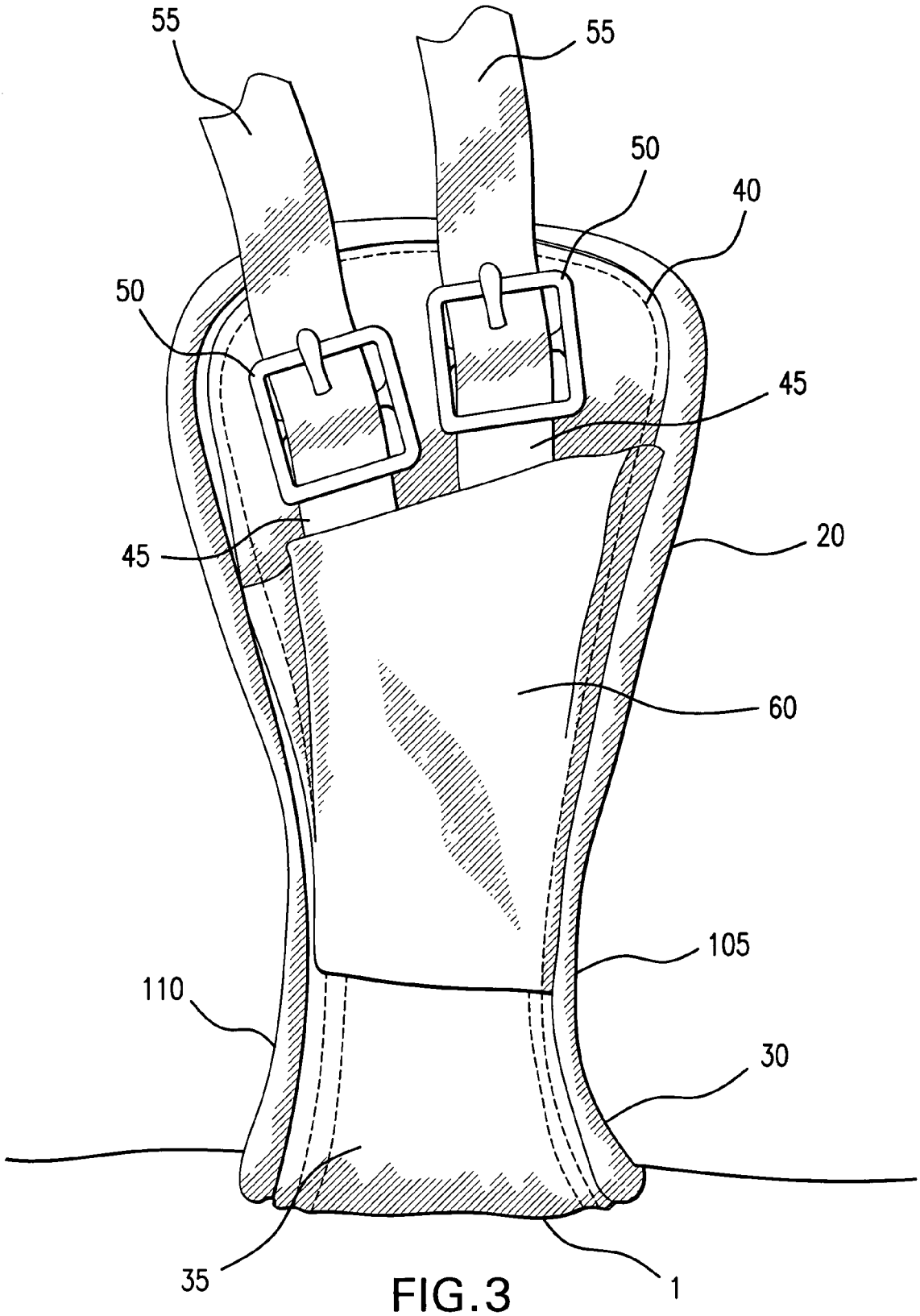
FIG. 3 is a side view of the distal end of the saddle girth as attached to a saddle.

FIG. 3 shows the distal end 20 of the saddle girth 1 in its embodiments for the use with Dressage saddles as used in combination with a saddle (not shown). The saddle girth 1 is removably attached to the saddle with the connectors 50 attached to the saddle girth 1 by the connector strap 45. The connector strap 45 may consist of one or more members and is made of an elastic material which will allow the saddle girth 1 to conform and hold snug against the rib cage of a horse without chafing. The connectors 50 are typically buckles such as roller buckles and have a mechanism to attach the saddle girth 1 to the saddle straps 55 so that the saddle girth 1 may be secured to the saddle in a manner which is typical in the art.

Figure 4:
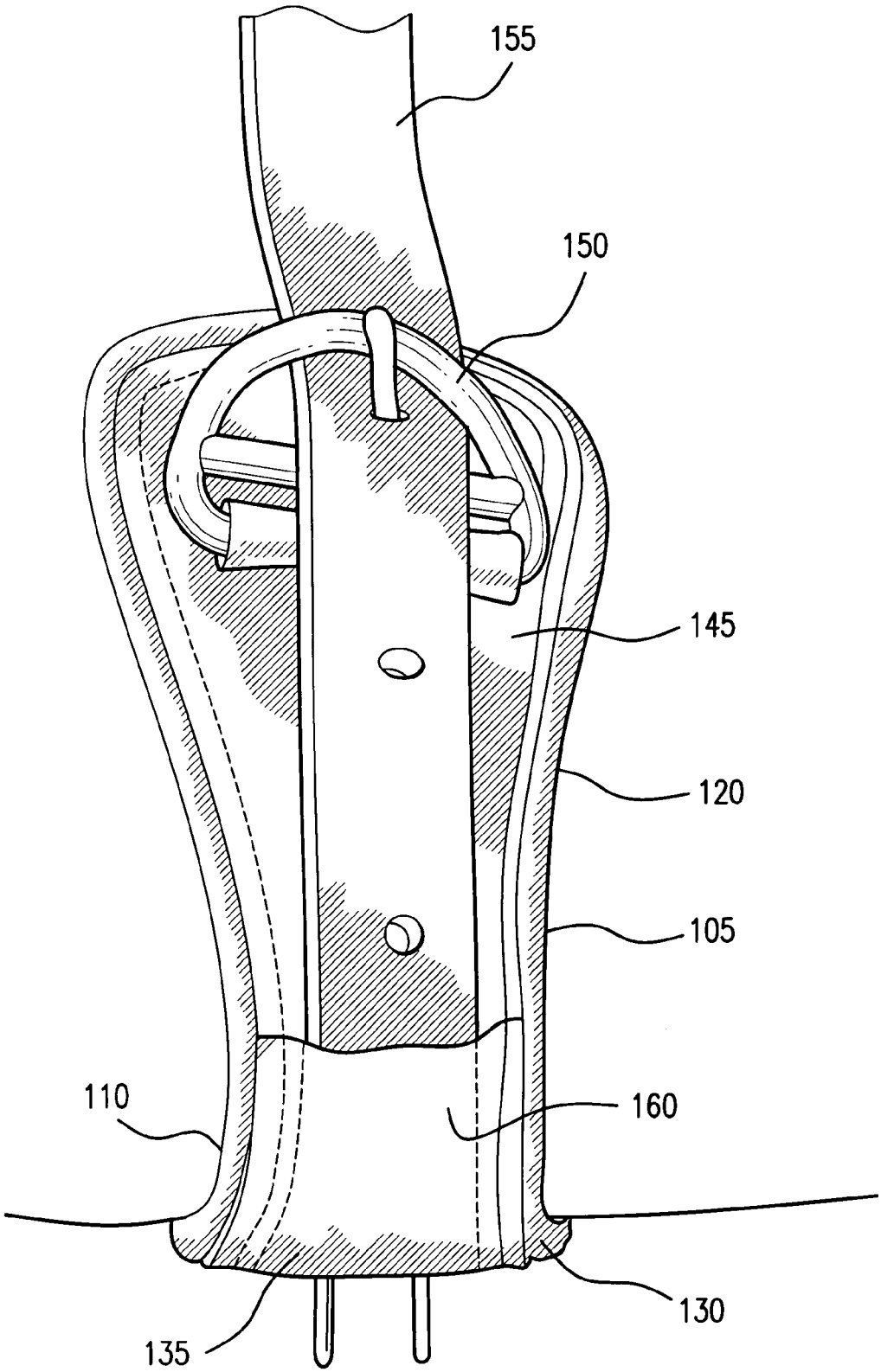
FIG. 4 is a side view of the distal end of the saddle girth as attached to a western saddle.

FIG. 4 shows the distal ends 120 of the western saddle girth 101 in its alternative embodiment for the use with Western saddles as used in combination with a western style saddle (not shown). The western saddle girth 101 is removably attached to the saddle with the connectors 150 attached to the western saddle girth 101 by the connector strap 145. The connector strap 145 is made of an elastic material which will allow the saddle girth 101 to conform and hold snug against the rib cage of a horse without chafing. The connectors 150 are typically buckles such as roller buckles and have a mechanism to attach the western saddle girth 101 to the saddle strap 155 so that the western saddle girth 101 may be secured to the saddle in a manner which is typical in the art.

Figure 5:
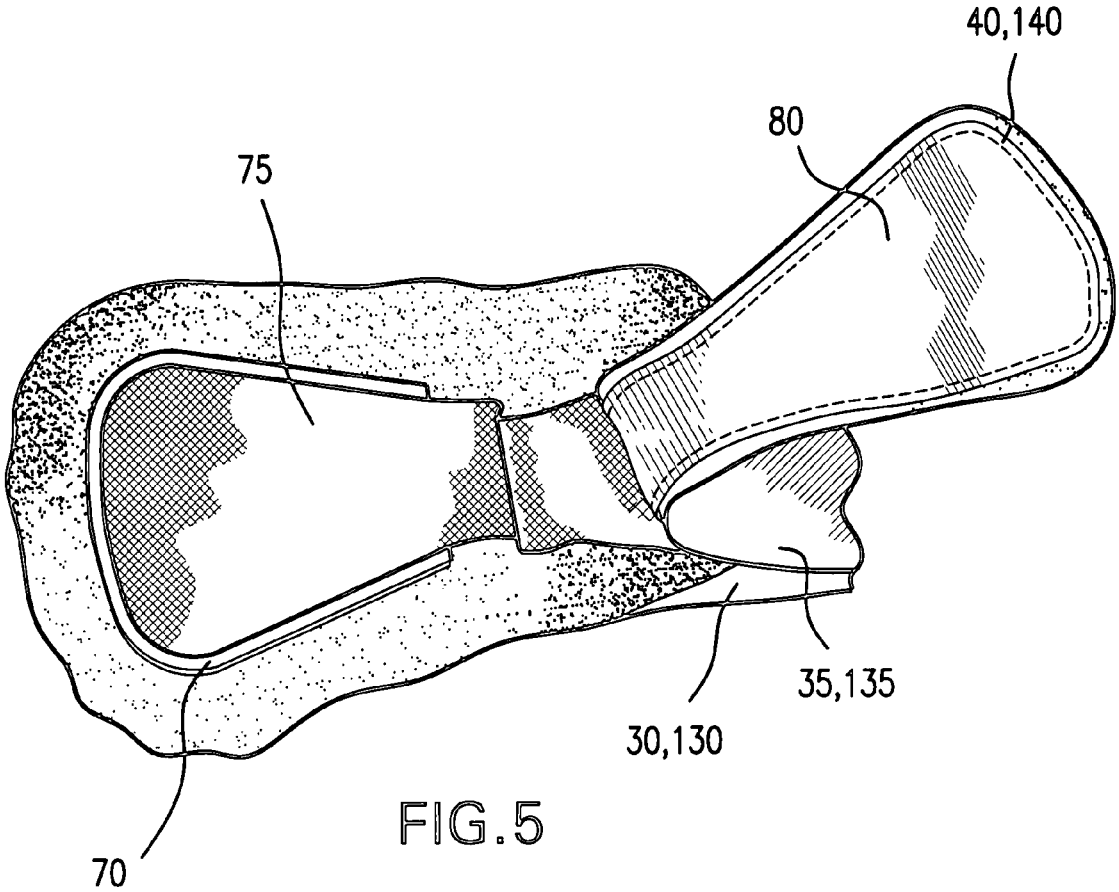
FIG. 5 is an exploded view of the saddle girth illustrating the layers which comprise the saddle girth.

FIG. 5 is an exploded view of the distal ends 20, 120 of the saddle girth 1 and western saddle girth 101, and illustrates the layers comprising the invention. The saddle girth 1, 101 in its preferred embodiment consists of five layers, the inside surface 30, 130 made of leather or similar material lies against the body of the horse. The inside surface 30, 130 may be constructed of leather, and in its preferred embodiment is of a chrome tanned leather less than 1.8 millimeters in thickness. However, the inside layer 30, 130 may be made of material other than leather with varying thickness. Fixedly attached to the inside layer 30, 130 is a pad 70 consisting of one or more sections located at pressure points caused by the connectors or other buckles. The pad 70 may be made from most any material capable of being compressed and/or absorbing shock including foam rubber, neoprene, latex or other similar material. Layered on top of the pad 70 is the inelastic layer 75 which is fixedly attached to both the inside layer 30, 130 and the pad 70 by glue or any similar method for fixing fabrics and materials. The inelastic layer 75 is made of polyvinyl chloride (PVC) woven material or other material with similar inelastic properties. The outside surface 35, 135 and the inside surface 30, 130 are joined together by stitching 40, 140, although other methods for joining fabrics and materials known in the art may be used. Between the outside surface 35, 135 and the inside surface 30, 130 a linen layer 80 is sandwiched between the inelastic layer 75 and the outside surface 35, 135 and is fixedly attached to the outside layer 30, 135 by stitching or similar method for joining fabrics and materials.

Of course, it is understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as taught herein without necessarily achieving other objects or advantages as may be taught or suggested herein.

Although this invention has been disclosed in the context of certain preferred embodiments and examples, it therefore will be understood by those skilled in the art that the present invention extends beyond the specifically disclosed embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

We claim:

1. A saddle girth comprising a midsection and two distal ends; the midsection having a forward edge and a rearward edge; the forward edge and rearward edge being curved, the distance between the forward edge and the rearward edge being the greatest at a midpoint of the midsection between the two distal ends and the distance between the forward edge and the rearward edge narrowing as the midsection approaches each of the two distal ends, the distal ends connected at an angle to a centerline of the saddle girth; an inside surface joined to an outside surface; at least one connector strap attached to each of the distal ends of the saddle girth, wherein the distal ends are angled from the centerline of the saddle girth at an angle between 5 degrees and 45 degrees and wherein the one connector strap attached to each of the distal ends extends from the centerline of the saddle girth in the same direction as the distal ends, wherein said distal ends and said at least one connector strap are pre-fabricated with said angle.

2. The saddle girth of claim 1 wherein each of the at least one connector straps attached to each of the distal ends of the saddle girth is made of an elastic material.

3. The saddle girth of claim 2, comprising at least one pad joined to the inside surface, an inelastic layer located between said pad and said outside layer and joined to said outside layer.

4. The saddle girth of claim 1, wherein each of the two distal ends are angled from the centerline at an angle of 30 degrees.

5. The saddle girth of claim 1, comprising one or more pads fixedly attached between the inside surface and the outside surface.

6. The saddle girth of claim 1 comprising the inside surface and the outside surface being formed by a piece of leather and a compressible pad being attached to the piece of leather that forms the inside surface, an inelastic polyvinyl chloride woven material on top of the pad and a linen layer between the inelastic layer and piece of leather that forms the outside surface.

7. A saddle girth comprising a midsection and two distal ends; said midsection having a forward edge and a rearward edge; said forward edge and rearward edge being curved such that the girth band is widest at its midpoint and narrowing at the ends of said midsection; said midsection and said distal ends curving backwards from a centerline of the saddle girth at an angle between 5 degrees and 45 degrees; an inside surface joined to an outside surface; a linen layer joined to the inside surface, at least one pad joined to the inside surface, an inelastic layer located between said pad and said outside surface and joined to said outside surface, at least one connector strap made of an elastic material attached to each said distal end of said saddle girth; and a connector attached to each said connector strap wherein the at least one connector strap angles away from the centerline of the saddle girth in the same direction as the distal ends, wherein said distal ends and said at least one connector strap are pre-fabricated with said angle.

8. The saddle girth of claim 7 wherein the distal ends are angled from the centerline at an angle of 30 degrees.

* * * * *